US008172483B2

(12) United States Patent
Dimitrijevic

(10) Patent No.: US 8,172,483 B2
(45) **Date of Patent: *May 8, 2012**

(54) FOUNDATION UNDERPINNING

(76) Inventor: Mark Anthony S. Dimitrijevic, Deer Park, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/180,097

(22) Filed: Jul. 25, 2008

(65) Prior Publication Data

US 2010/0021243 A1 Jan. 28, 2010

(51) Int. Cl.
*E02D 5/30* (2006.01)

(52) U.S. Cl. ..... 405/230

(58) Field of Classification Search ..... 405/230, 405/231, 232, 251, 252
See application file for complete search history.

(56) References Cited

U.S. PATENT DOCUMENTS

| | | | | |
|---|---|---|---|---|
| 2,187,677 | A * | 1/1940 | Brumley | 405/250 |
| 4,627,769 | A * | 12/1986 | Lee | 405/256 |
| 5,096,333 | A * | 3/1992 | Bassett | 405/244 |
| 5,288,175 | A | 2/1994 | Knight | |
| 5,399,055 | A | 3/1995 | Dutton, Jr. | |
| 6,632,048 | B2 | 10/2003 | Greenberg | |
| 6,848,864 | B1 * | 2/2005 | Davie et al. | 405/230 |
| 6,951,437 | B2 | 10/2005 | Hall | |
| 7,090,435 | B2 | 8/2006 | Mitchell | |
| 2004/0141814 | A1 | 7/2004 | Covington | |
| 2010/0021242 | A1 | 1/2010 | Dimitrijevic | |
| 2010/0021244 | A1 | 1/2010 | Dimitrijevic | |

FOREIGN PATENT DOCUMENTS

| | | | |
|---|---|---|---|
| GB | 2172038 A | * | 9/1986 |
| JP | 55095714 A | * | 7/1980 |
| JP | 06073991 A | * | 3/1994 |

OTHER PUBLICATIONS

Office Action dated Aug. 10, 2009 issued in connection with U.S. Appl. No. 12/180,103.
Final Office Action dated Feb. 22, 2010 issued in connection with U.S. Appl. No. 12/180,103.
Office Action dated Apr. 15, 2010 issued in connection with U.S. Appl. No. 12/180,110.
Final Office Action dated Aug. 19, 2010, U.S. Appl. No. 12/180,110.
Response to Office Action dated Apr. 15, 2010, filed Jul. 14, 2010, U.S. Appl. No. 12/180,110.
Request for Continued Examination and Response to Final Office Action dated Aug. 19, 2010, filed Dec. 22, 2010, U.S. Appl. No. 12/180,110.
Response to Office Action dated Aug. 10, 2009, filed Nov. 10, 2009, Application No. 12/180,103.
Request for Continued Examination and Response to Final Office Action dated Feb. 22, 2010, filed Jun. 22, 2010, U.S. Appl. No. 12/180,103.
Office Action dated Aug. 27, 2010, U.S. Appl. No. 12/180,103.
Response to Office Action dated Aug. 27, 2010, filed Dec. 22, 2010, U.S. Appl. No. 12/180,103.

* cited by examiner

*Primary Examiner* — Sunil Singh
(74) *Attorney, Agent, or Firm* — Conley Rose, P.C.

(57) ABSTRACT

A foundation underpinning is disclosed. In some embodiments, the foundation underpinning includes a pile having one or more pile segments and an elongated reinforcing tubular member. Each of the one or more pile segments includes a throughbore passing axially through the head and the trunk. The throughbores of the one or more pile segments are vertically aligned forming a passage through the pile, and the elongated reinforcing tubular is disposed within the passage.

17 Claims, 6 Drawing Sheets

FOUNDATION UNDERPINNING

CROSS-REFERENCE TO RELATED APPLICATIONS

None.

STATEMENT REGARDING FEDERALLY SPONSORED RESEARCH OR DEVELOPMENT

Not applicable.

BACKGROUND

1. Field of the Invention

The present invention relates generally to an apparatus and methods for foundation underpinning. More particularly, the invention relates to an apparatus and method for employing a foundation piling system to support and level an existing building foundation.

2. Background of the Invention

Several methods and systems have been developed and used for lifting, leveling and stabilizing above-ground structures such as buildings, slabs, walls, columns, etc. One conventional technique employs a stack, or pile, of pre-cast concrete pile segments that is positioned underneath, and supports, the structure to be stabilized and leveled. Typically, a hole is dug underneath the structure to a depth slightly greater than the length of a pile segment. Multiple pile segments are then driven into the ground one on top of the other until a particular depth is reached, thereby forming a vertical stack, or pile, of the pile segments. The pile segments are driven into the ground until a rock strata is encountered, or until the resulting pile is believed to be sufficiently deep to adequately support the structure. In situations where a rock strata cannot be reached, the pile segments are driven to a depth great enough to cause sufficient friction between the earth and the outer surfaces of the pile to prevent substantial vertical movement of the pilings. A jack is next positioned on the upper surface of the pile, between the uppermost pile segment and the structure. Finally, the structure is raised to the desired height.

There are several disadvantages to this conventional technique. Other than being stacked one on top of another, the concrete segments are typically not connected. Thus, the individual pile segments may become misaligned during installation. In some cases, substantial misalignment can negatively impact the stability and strength of the entire pile. In addition, determining the installed pile depth typically requires monitoring the quality and number of pre-cast concrete segments used to form the pile. Further, in most cases, the completed pile is not reinforced. Over time, the cyclical shrinking and swelling of the soil surrounding the piles can cause shifting of individual pile segments, potentially resulting in misalignment and weakening of the pile. Still further, the individual pre-cast pile segments are often cylindrical in shape. As each pile segment is driven into the ground, the entire outer radial surface of each pile engages the surrounding earth, resulting in relatively large frictional forces which can inhibit continued advancement of the individual pile into the ground.

Another conventional method utilizes a flexible cable to lock the individual pile segments together as a unit, thereby reducing misalignment of the concrete segments. A typical example of this methodology is found in U.S. Pat. No. 5,288,175. A starter concrete pile segment with a high strength steel cable anchored to and extending from the center of the starter segment is first driven into the soil beneath the foundation using a hydraulic jack. Multiple concrete segments, each having a central throughbore, are then sequentially threaded onto the cable and driven into position, each one on top of the other to form the complete pile that is used to support and level the structure. The cable is intended to promote vertical alignment of the pile segments. It also permits pile penetration depth to be determined, either by reading a strand marker or calculating it by measuring the length of cable used to lock the pile together.

In an effort to drive the individual pile segments deeper to achieve a more stable pile, and to reduce the time required to drive the pile segments, some conventional underpinning methods jet or spray a fluid into the soil beneath the lowermost pile segment. A typical example of this installation method is found in U.S. Pat. No. 5,399,055. Similar to other conventional methods, the individual pre-cast concrete segments are pressed or driven vertically into the soil using a hydraulic jack. When the concrete segments cannot be driven further, fluid is injected downward through holes formed in the concrete segments. The fluid moistens and loosens the soil beneath the pile, allowing the pile to be driven deeper and to be driven deeper more easily than would have otherwise been possible. After discontinuing the fluid jetting, additional concrete segments are positioned on the pile and driven downward using the hydraulic jack. Fluid is again injected through the concrete segments once the pile cannot be driven further downward. After the fluid jetting is discontinued, additional concrete segments positioned on the pile and driven downward, and so on. This process is repeated until the desired pile depth is reached. To promote alignment of the concrete segments, a reinforcing rod may be inserted into the holes formed in the concrete segments. Finally, in some cases, grout is injected into the annulus formed between the outer surface of the reinforcing rod and the inner surface of the holes through the concrete pile segments in an effort to solidify the pile as a unitary structure.

These relatively advanced methods of fluid jetting, however, are not without disadvantages. In particular, alignment of the pile segments is not always assured. When the pile segments are driven in, they are in no way connected, such as by a cable or reinforcing rod. As a result of such misalignment, jetting fluid may not reach the base of the pile. Therefore, the soil beneath the pile may not be moistened by the jetting fluid, preventing the pile from being driven as deep as desired. Also as a result of pile segment misalignment, it may not be possible to later insert the reinforcing rod through the entire depth of the pile. Nor may it be possible to inject grout the full length of the pile. Thus, the pile may be misaligned as well as not reinforced over portions of its length.

Accordingly, there remains a need in the art for a foundation underpinning apparatus and methods that offer the potential to maintain the alignment of the individual pre-case pile segments forming a pile both during and after installation. Such a foundation underpinning would be particularly well received if it could be installed deeper and more efficiently than known installation methods permit.

BRIEF SUMMARY OF SOME OF THE PREFERRED EMBODIMENTS

A foundation underpinning is disclosed. In some embodiments, the foundation underpinning includes a pile having one or more pile segments and an elongated reinforcing tubular member. Each of the one or more pile segments includes a head, a trunk extending from the head, and a throughbore passing axially through the head and the trunk. The throughbore has a longitudinal centerline. The area of a cross-section through the head and normal to the centerline is greater than the area of a cross-section through the trunk and normal to the centerline. The throughbores of the one or more pile segments are vertically aligned forming a passage through the pile. The elongated reinforcing tubular is disposed within the passage.

Some methods of installing the foundation underpinning include driving the first pile segment downward into the soil, inserting a first elongate tubular segment at least partially into the throughbore of the first pile segment, and coupling a second elongate tubular segment to the first elongate tubular segment, wherein the first and the second elongate tubular segments are coupled end-to-end. The methods further include positioning the second pile segment on top of the first pile segment, wherein the throughbore of the second pile segment is vertically aligned with the throughbore of the first pile segment and the second elongate tubular segment extends at least partially into the throughbore of the second pile segment.

Thus, embodiments described herein comprise a combination of features and advantages intended to address various shortcomings associated with certain prior devices. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a more detailed description of the preferred embodiments, reference will now be made to the accompanying drawings, wherein.

DETAILED DESCRIPTION OF PREFERRED EMBODIMENTS

Figure 1:
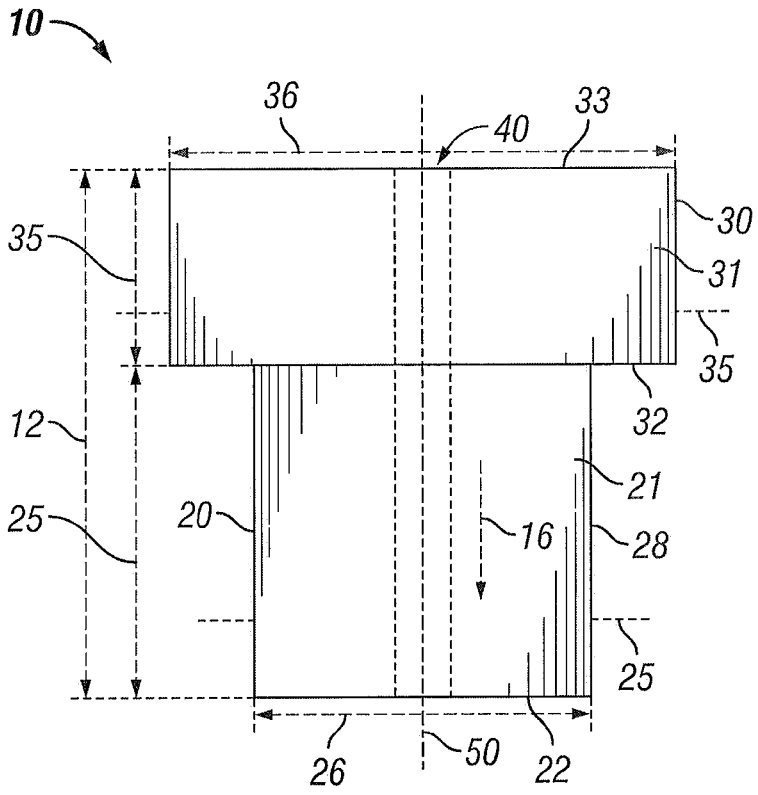
FIG. 1 is a front elevation view of an embodiment of an individual pile segment used to construct a pile in the ground.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices and connections.

Figure 2:
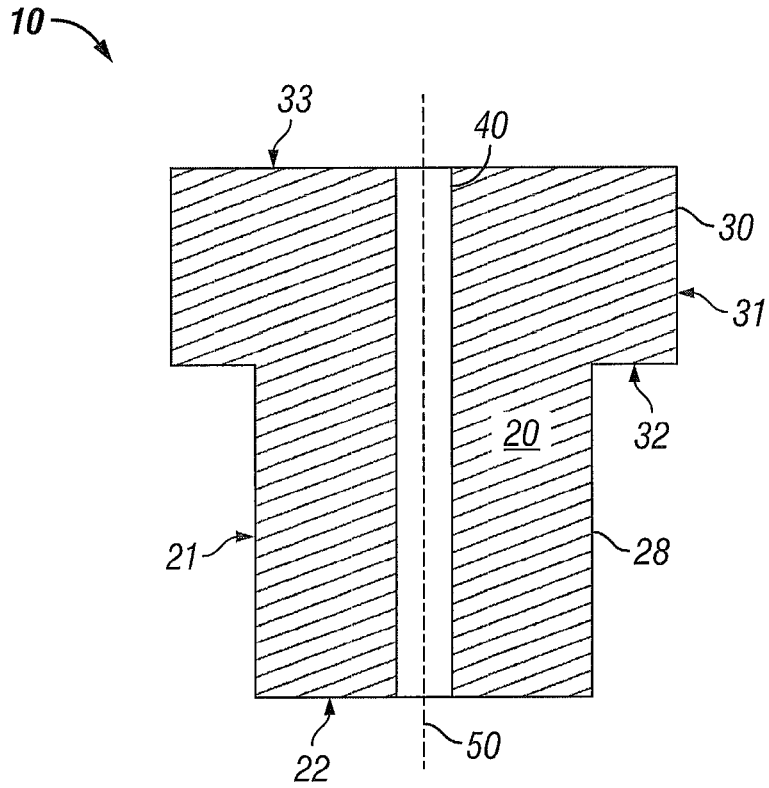
FIG. 2 is a cross-sectional view of the individual pile segment of FIG. 1.

Referring now to FIGS. 1 and 2, an embodiment of an individual pile segment 10 is illustrated. Pile segment 10 has a longitudinal axis 50, and comprises a body 20 and a vertical throughbore 40 extending through body 20 generally parallel to axis 50. In particular, throughbore 40 is centrally positioned, and shares the same axis 50 as pile segment 10. Body 20 includes a trunk 28 and a head 30 disposed at the upper end of trunk 28. In this embodiment, head 30 is integral with trunk 28.

In this embodiment, trunk 28 is substantially cylindrical, having an outer radial or side surface 21 and a lower axial surface 22. Trunk 28 has a height 25 measured substantially parallel to axis 50 and a diameter 26 measured substantially perpendicular to axis 50. Thus, as used herein, the term "height" refers to dimensions and distances measured substantially parallel to the longitudinal axis of a body, while the terms "diameter" and "width" refer to dimensions and distances measured substantially perpendicular to the longitudinal axis of a body. Likewise, head 30 is substantially cylindrical, having an outer radial or side surface 31, a lower annular axial surface 32, and an upper axial surface 33. Head 30 has a height 35 and a diameter 36. Collectively, trunk 28 and head 30 define an overall height 12 of body 20 and pile segment 10.

It should be appreciated that height 35 of head 30 is less than height 25 of trunk 28, and further, diameter 36 of head 30 is greater than diameter 26 of trunk 28. For reasons that will be explained in more detail below, the ratio of diameter 36 of head 30 to diameter 26 of trunk 28 is preferably greater than 1.0.

Since head 30 has a diameter 36 that is greater than the diameter 26 of trunk 28 in this embodiment, body 20 of pile segment 10 has a general "T-shaped" profile and cross-section as best seen in FIG. 2. In other words, a first cross-section through the head (e.g., head 30) and perpendicular to the pile segment axis preferably has a first cross-sectional area that is greater than a second cross-sectional area of a second cross-section taken through the trunk (e.g., trunk 28) perpendicular to the pile segment axis. For example, a first cross-section taken at a first plane 35 through head 30 and perpendicular to axis 50 has a first cross-sectional area that is greater than a second cross-sectional area of a second cross-section through trunk 28 taken at a second plane 25 perpendicular to axis 50.

Although head 30 and trunk 28 are shown as cylindrical, in general, head 30 and trunk 28 may comprise any suitable shapes. For reasons that will be explained in more detail below, head 30 and trunk 28 are preferably configured and shaped such that any cross-section through head 30 is larger than any cross-section through trunk 28. For instance, as shown in FIGS. 1 and 2, head 30 and trunk 28 may both be cylindrical, with head 30 having a larger diameter than trunk 28 (i.e., body 20 is "T-shaped"). As yet another example, body 20 may be conical, with the diameter of body 20 generally increasing from the lower trunk toward the upper head.

Pile segment 10 may comprise any suitable material including, without limitation, a metal, a metal alloy, a non-metal, a composite, or combinations thereof. However, pile segment 10 preferably comprises a relatively rigid material capable of withstanding compressional forces. Thus, concrete is a particularly suitable material for pile segment 10 since concrete is readily available, relatively cheap, and has suitable compressional strength.

Figure 3:
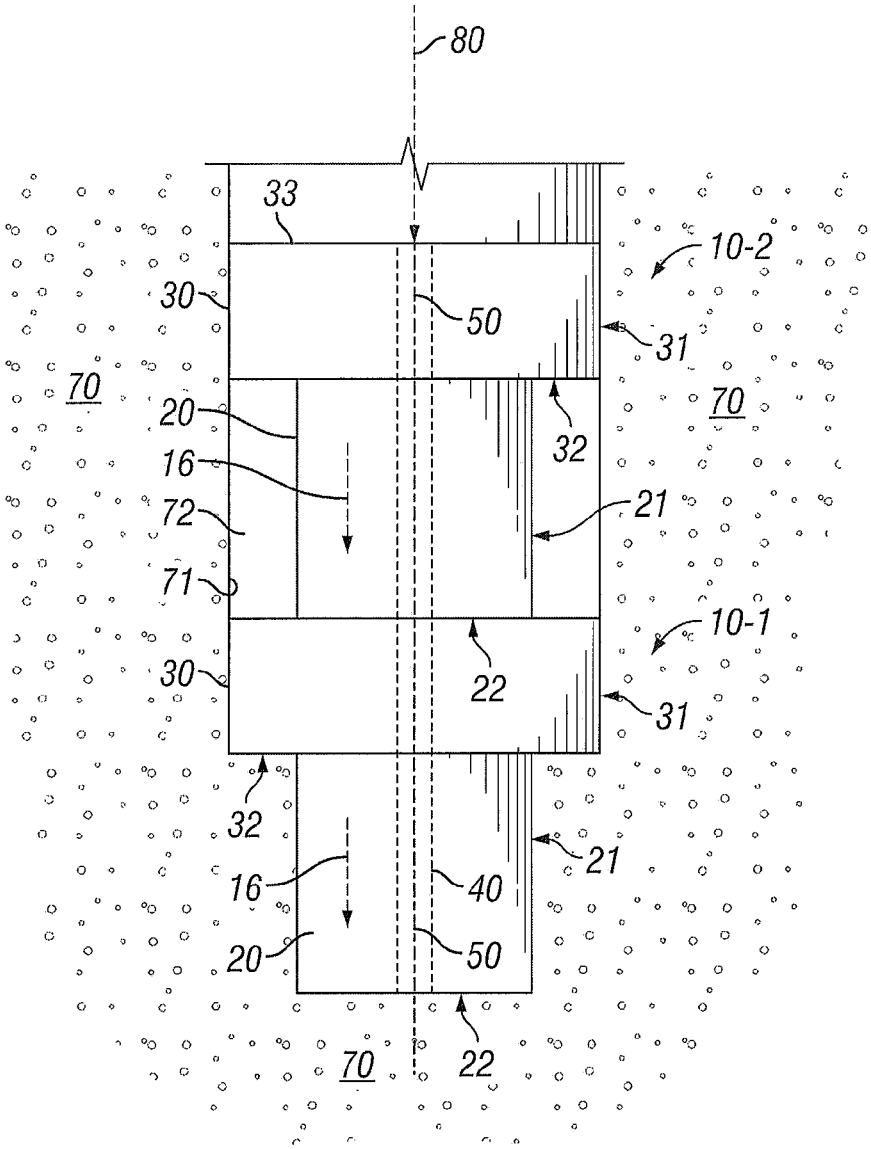
FIG. 3 is a schematic view of two of the individual pile segments of FIG. 1 being driven into the ground to form a pile.

Referring now to FIG. 3, two pile segments 10, as previously described, are shown vertically stacked on each other and driven into the ground or soil 70 to form a pile or underpinning. For purposes of further explanation, pile segments 10 are assigned reference numerals 10-1 and 10-2, there being a first or lower pile segment 10-1 and a second or upper pile segment 10-2 shown in FIG. 3.

Lower pile segment 10-1 is driven vertically into the ground in the direction of arrow 16 by a force 80. Then, second pile segment 10-2 is placed on top of first pile segment 10-1, and both first pile segment 10-1 and second pile segment 10-2 are driven into the ground together. In particular, pile segments 10-1 and 10-2 are vertically aligned, with axes 50 substantially aligned, as they are stacked on each other and driven into the ground 70. In general, vertical alignment of pile segments (e.g., pile segments 10-1, 10-2, etc.) that form a pile is preferred to promote stability and support. As used herein, the term "vertical" or "vertically" may be used to refer to the orientation of the axis of a body (e.g., axis 50 of pile segment 10), a force, or a direction, that is substantially perpendicular to the surface of the ground. Since pile segment 10-1 is first driven into the soil 70 followed by pile segment 10-2, pile segment 10-1 may be described as the "leading" pile segment and second pile segment 10-2 may be described as a "trailing" pile segment. Likewise, since each pile segment 10-1, 10-2 is driven vertically into the ground with trunk 28 first, followed by head 30, for a given pile segment 10, trunk 28 may be described as "leading" and head 30 may be described as "trailing."

Pile segments 10-1 and 10-2 are driven vertically into the soil 70 in the direction of arrows 16 by force 80 applied to upper axial surface 33 of upper pile segment 10-1. As pile segments 10-1 and 10-2 are vertically stacked and driven into the soil 70, lower axial surface 22 of trunk 28 of trailing pile segment 10-2 engages, and transfers force(s) 80 to the upper axial surface 33 of head 30 of the leading pile segment 10-1. Force 80 may be provided by any suitable device capable of driving a pile segment (e.g., pile segment 10) into the ground including, without limitation, a jack (e.g., a hydraulic jack, a mechanical jack, a pneumatic jack, etc.), an actuator, or combinations thereof.

Unlike pile segments 10-1, 10-2, most conventional pile segments are cylinders having a constant or uniform diameter along their entire height. Consequently, when each such conventional pile segment is driven vertically into the ground, the entire outer radial surface of the cylinder engages the surrounding soil. As a result, frictional forces arise along the entire height of each such conventional pile segment (the first as well as each subsequent conventional pile segment driven into the soil). Such frictional forces resist continued advancement of the conventional pile segments into the ground, thereby increasing the time and forces required to sufficiently drive such conventional pile segments into the soil.

As shown in FIG. 3, each pile segment 10 includes an upper head 30 having a diameter 36 that is greater than the diameter 26 of its lower trunk 28. Thus, pile segments 10 do not have a constant diameter or width along their entire heights. As a result, when leading pile segment 10-1 is driven vertically into the soil 70 in the direction of arrow 16, both side surfaces 21, 31 engage the surrounding earth, generating frictional forces therebetween. However, head 30 of leading pile segment 10-1 at least partially creates a pathway 71 for trailing pile segment 10-2. The width or diameter of pathway 71 will be substantially the same as diameter 36 of the head 30 of leading pile segment 10-1. Thus, as trailing pile segment 10-2 is stacked and driven into the soil 70, side surface 31 of head 30 of trailing pile segment 10-2 engage the surrounding soil generating frictional forces therebetween. However because head 30 of leading pile segment 10-1 has generated a bore greater than the diameter of side surface 21 of trunk 28 of trailing pile segment 10-2, engagement between side surface 21 of trailing pile segments 10-2 is believed to be significantly reduced. Further, since height 35 of head 30 is relatively small, as compared to the overall height of a conventional cylindrical pile segment of similar size as pile segment 10, the frictional forces acting on side surface 31 of trailing pile segment 10-2 act over a much smaller surface area than frictional forces acting on a conventional cylindrical pile segment. In general, the less contact between a pile segment (e.g., pile segment 10-2) and the surrounding soil, the faster and easier it is to drive the pile segment. Consequently, as compared to similarly sized conventional cylindrical pile segments whose entire outer radial surface engages the soil, embodiments of pile segment 10 offer the potential for increased driving speed and ease. It should be appreciated that the slope of the outer surface of leading pile segment 10-1 may be optimized to make the initial hole in the ground, as for example cone shaped instead of T-shaped.

After pile segments 10-1 10-2 are driven to the desired depth, lower axial surface 22 and lower annular axial surface 32 of pile segments 10-1 provide bearing surface area to level and support a structure above pile segments 10-1, 10-2. The surrounding soil 70 begins to collapse against side surface 21 of pile segment 10-2. Over time, a space 72 between outer surface 21 of pile segment 10-2 and the outer edge of pathway 71, between head 30 of pile segment 10-1 and head 30 of pile segment 10-2, is filled in by the collapsing soil 70. Once space 72 is filled in by soil 70, pile segment 10-2 is laterally supported by soil 70. Moreover, lower annular axial surface 32 of pile segment 10-2 engages soil 70 and provides additional bearing surface area.

Figure 4:
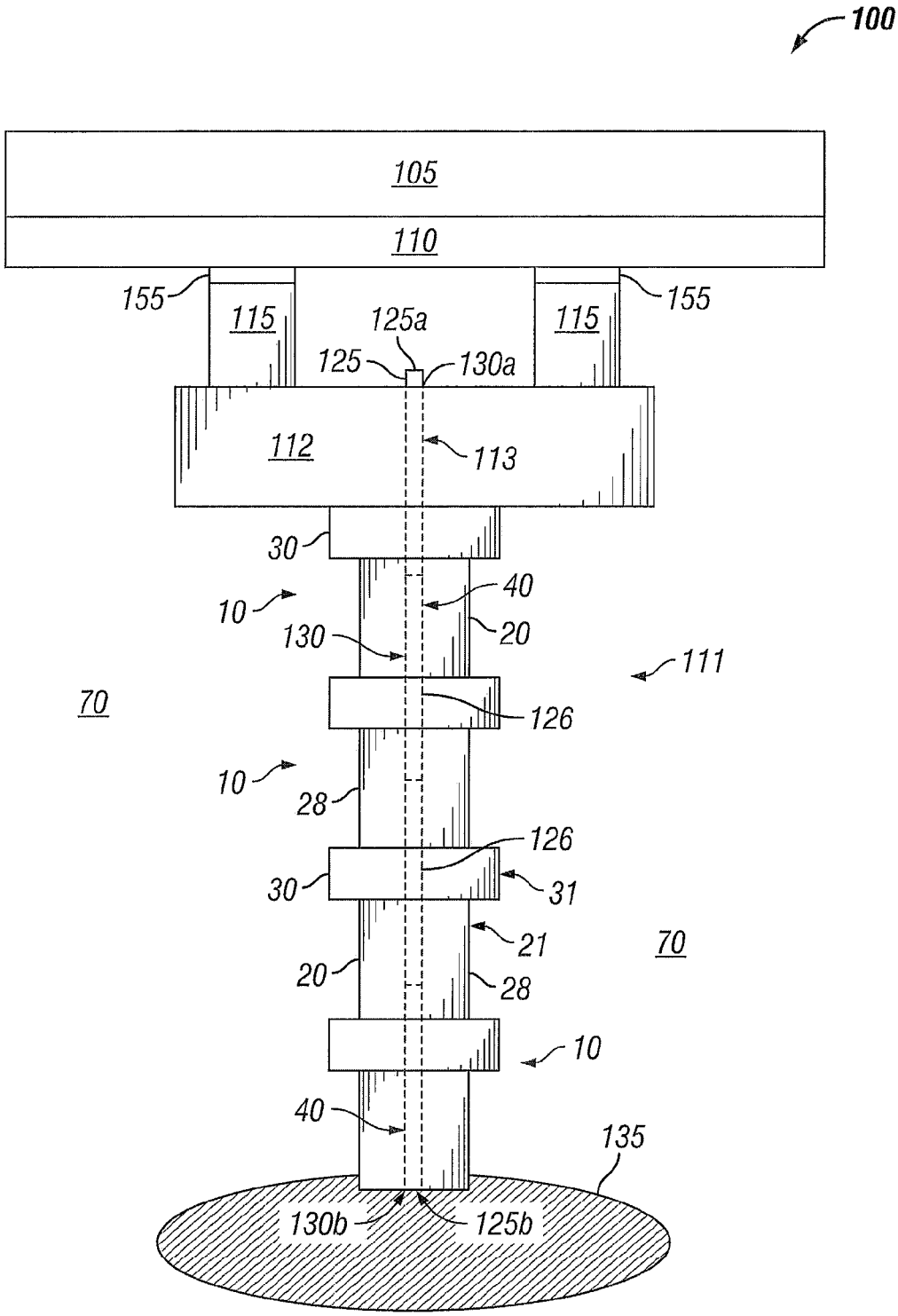
FIG. 4 is a schematic view of an embodiment of a foundation underpinning including a plurality of the individual pile segments of FIG. 1.

Referring now to FIG. 4, an embodiment of a foundation underpinning 100 that supports and/or levels a structure 105 and its foundation or slab 110 is illustrated. It is to be understood that structure 105 may be a commercial or residential building, a new construction or an existing structure, a wall, a column, or any other structure requiring support, stabilization, leveling, or combinations thereof. Typically, but not necessarily, slab 110 is constructed of concrete.

Underpinning 100 comprises a stack or pile 111, a cap 112, and spacers 115. Vertical pile 111 includes one or more individual pile segments 1 0 as previously described vertically aligned and stacked on each other within the surrounding soil 70. Thus, as used herein, the term "pile" may be used to refer to a vertical stack of one or more individual pile segments (e.g., pile segments 10). Further, the term "pile" may be used to describe a vertical stack of one or more pile segments both during construction of an underpinning (i.e., while driving pile segments into the ground), and following completion of an underpinning.

Cap 112 and spacers 115 are positioned between pile 111 and slab 110, and are supported from below by pile 111. Cap 112 includes a throughbore 113. Although a variety of other suitable shapes and materials may be employed, cap 112 preferably comprises a rigid rectangular concrete block and spacers 115 comprise rigid cylindrical pre-cast concrete segments (e.g., standard 6" diameter concrete spacers). In addition, underpinning 100 her comprises one or more shims 155 positioned between each spacer 115 and slab 110. In general, shims 155 ensure that the interface between the foundation underpinning 100 and the slab 110 is without "play", meaning the fit between the foundation underpinning 100 and the slab 110 is so snug that foundation underpinning 100 is substantially held in place (i.e., no substantial movement) beneath and supporting the slab 110. Shims 155 may be constructed of any suitable material, including without limitation, metals, metal alloys (e.g., steel), non-metals (e.g., wood, polymers, plastic), composites, or combinations thereof.

As previously described, pile segments 10 are vertically aligned and stacked to form pile 111. In particular, pile segments 10 are stacked with each of their throughbores 40 substantially aligned. Further, throughbore 113 of cap 112 is also aligned with bores 40, thereby forming a continuous passage 130 through cap 112 and pile 111 having an upper opening 130*a* in cap 112 and a lower opening 130*b* in the lowermost pile segment 10.

In this embodiment, underpinning 100 also includes an elongate rod 125 disposed within passage 130. In particular, rod 125 extends substantially through cap 112 and each pile segment 10 from proximal upper opening 130*a* to proximal lower opening 130*b* of passage 130. Rod 125 may be solid or a tubular. In this embodiment, rod 125 is a tubular having an upper or first opening 125*a* in fluid communication with a lower or second opening 125*b*. In either case, rod 125 is preferably rigid and is intended to provide structural support and reinforcement to underpinning 111. Thus, rod 125 may also be referred to as a reinforcing rod 125 or reinforcing tubular 125. Rod 125 may be constructed as pile 111 is built, or disposed in passage 130 following completion of pile 111.

Referring still to FIG. 4, in this embodiment, reinforcing rod 125 comprises a plurality of elongate rod segments 126 coupled together end-to-end. It is to be understood that rod segments 126 may be solid or tubular, depending on whether it is desired that reinforcing rod 125 be solid or tubular. Adjacent rod segments 126 may be coupled end-to-end by any suitable means including, without limitation, mating threads, a mating collar and nut, welding, or combinations thereof Regardless of the manner of coupling adjacent rod segments 126, the coupling or connection between adjacent rod segments 126 preferably fits within passage 130, thereby allowing reinforcing rod 125 to be disposed within passage 130 while allowing adjacent pile segments 10 to substantially engage each other end-to-end. For example, if throughbores 40 in each pile segment 10, and hence, passage 130 of pile 111, have a ⅝" diameter, rod segments 126 and the coupling or connecting means between adjacent rod segments 126 preferably have a diameter less than ⅝", for instance a ½" diameter. Further, in some embodiments, a nozzle may be coupled to the second opening 125*b* of reinforcing rod 125 such that fluid entering first opening 125*a* of reinforcing rod 125 exits reinforcing rod 125 through the nozzle.

Reinforcing rod 125 is intended to promote the vertical alignment of pile segments 10 during construction of pile 111, and serve to maintain the vertical alignment of pile segments 10 after completion of pile 111 by restricting lateral shifting or movement of pile segments 10 in pile 111 relative to each other. In this sense, inclusion of reinforcing rod 125 offers the potential to improve the overall stability and support capabilities of pile 111 and underpinning 100. In general, reinforcing rod 125 may comprise any suitable material including, without limitation metals (e.g., copper), metal alloys (e.g., steel), non-metals (e.g., polymer, PVC, etc.), or combinations thereof However, to promote and maintain vertical alignment of pile 111, reinforcing rod 125 preferably comprises a relatively rigid material capable of resisting the lateral shifting of pile segments 10 relative to each other. For instance, rod segments 126 may comprise galvanized pipe.

Referring still to FIG. 4, in this embodiment, foundation underpinning 100 is supported by surrounding soil 70 and a support base 135. As will be described in more detail below, support base 135 is preferably a substantially rigid mass formed by injecting a flowable material (i.e., base material) into the voids and spaces beneath pile 111, and allowing the flowable material to solidify. Examples of suitable base materials include, without limitation, concrete, grout, polyurethane, and other materials that can be flowed beneath pile 111 and then allowed to solidify, thereby forming support base 135. Once the material forming support base 135 solidifies and hardens, support base 135 restricts pile 111 and underpinning 100 from further settling into the soil over time. Support base 135 may be formed before or after pile 111 is completed.

The material forming support base 135 may be injected beneath pile 111 in any suitable manner. For instance, in embodiments having no reinforcing rod or tubular, the base material may be directly flowed through passage 130 or injected through a flexible tubular (not shown) disposed within passage 130. In embodiments including a solid reinforcing rod, the base material may be flowed through the annulus formed between passage 130 and the reinforcing rod. Still further, in embodiments including a tubular reinforcing rod, the base material may be flowed through the reinforcing tubular.

It should be appreciated that after pile 111 is driven into the soil 70 and underpinning 100 is positioned to support structure 105 and its foundation 110, the surrounding soil 70 will tend to settle and fill any spaces or voids adjacent side surfaces 21, 31 of each pile segment 10. As the surrounding soil settles into these spaces, it will provide additional lateral support to pile 111 and underpinning 100. Moreover, lower annular axial surface 32 of each pile segment 10 provides bearing surface area to level and/or support structure 105 and its foundation 110.

Figure 5:
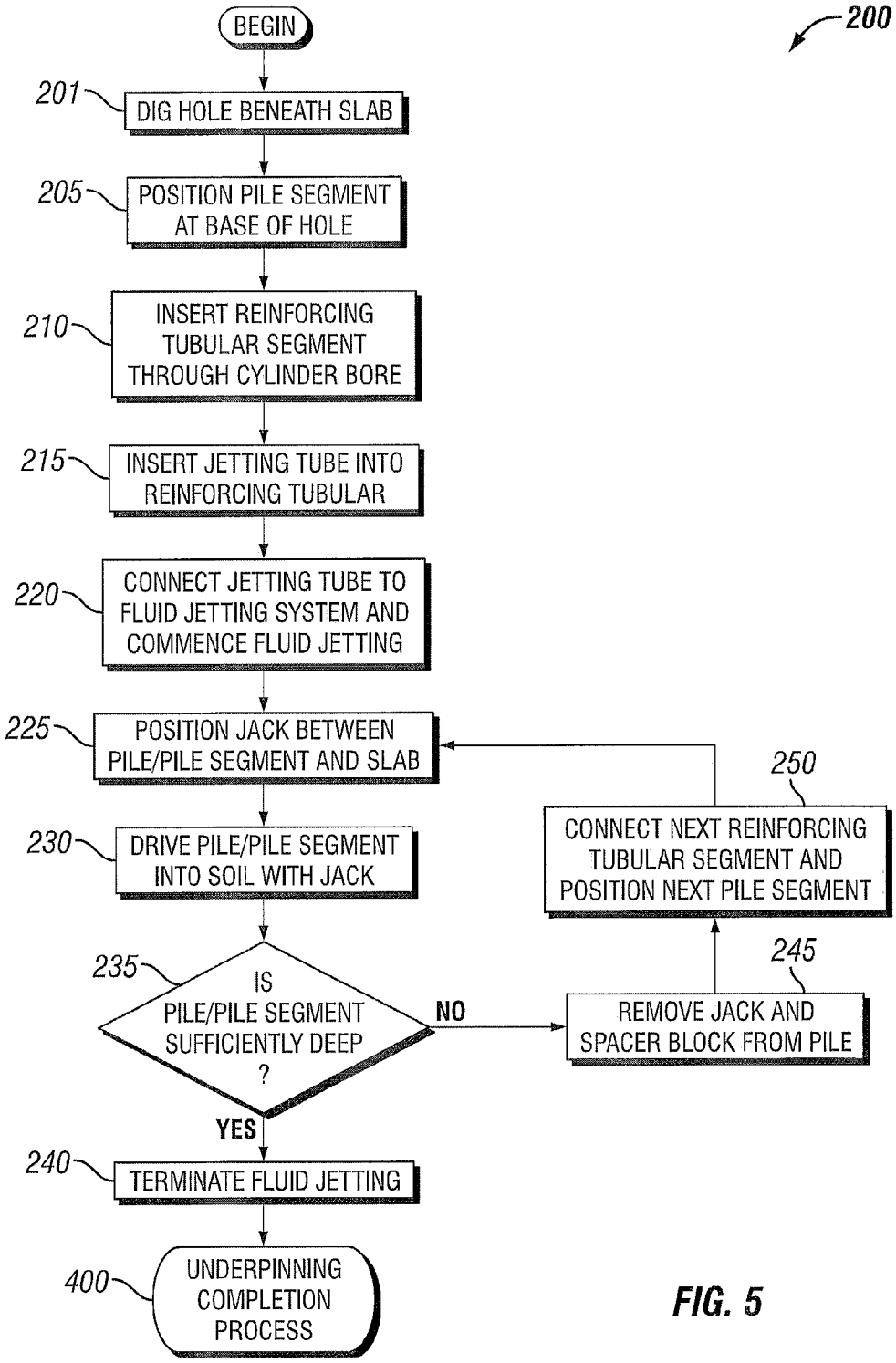
FIG. 5 is a logic flow diagram of a representative method to construct a pile of FIG. 4.
Figure 6:
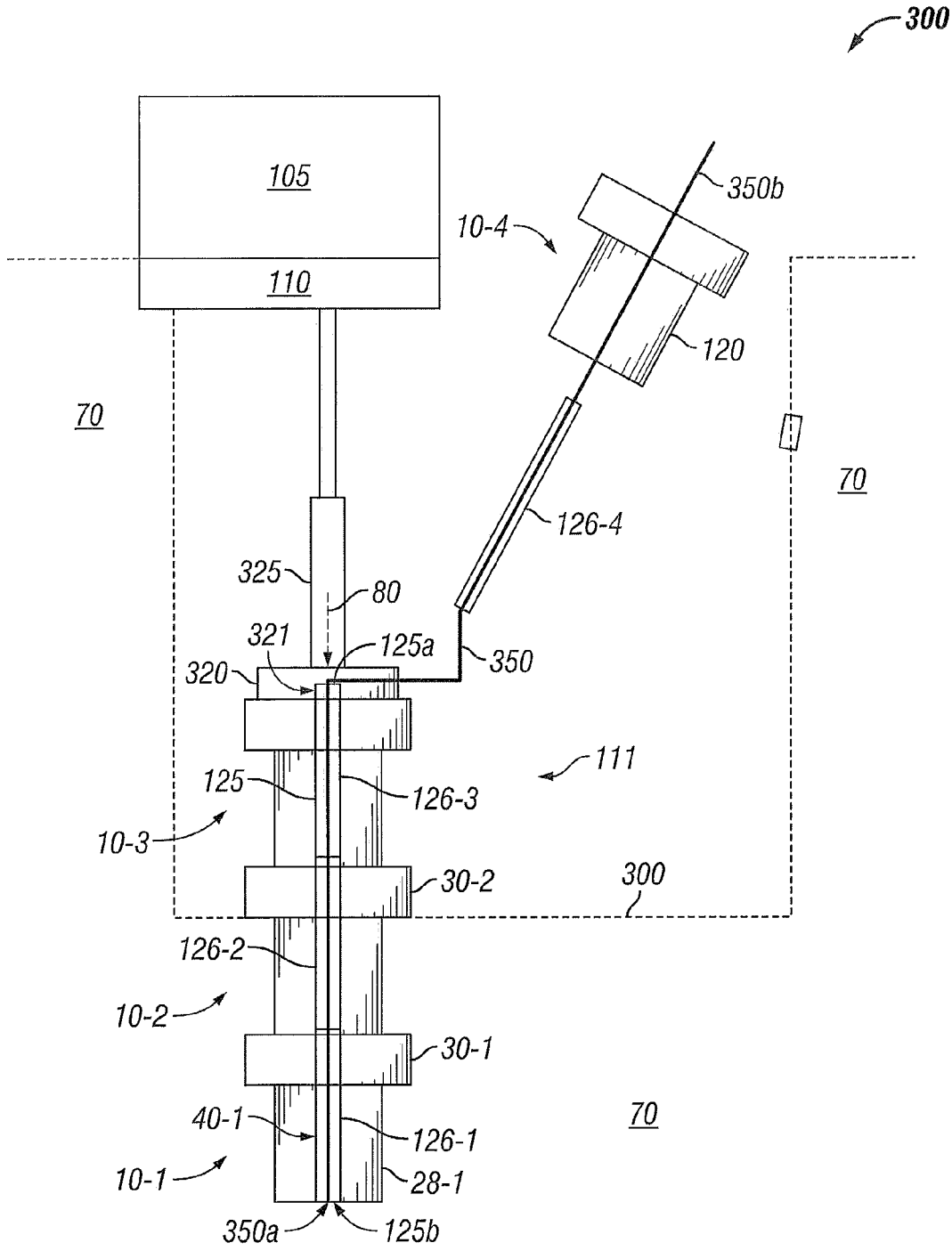
FIG. 6 is a schematic view of a pile being constructed in accordance with the representative method of FIG. 5.

Referring now to FIGS. 5 and 6, a representative method 200 to construct a pile (e.g., pile 111) is illustrated. For purposes of further explanation, pile segments 10 used to build pile 111 shown in FIG. 6 are assigned reference numerals 10-1, 10-2, 10-3, and 10-4, there being four representative pile segments illustrated in FIG. 6. Pile segment 10-1 is the bottom or lowermost pile segment 10, followed by pile segment 10-2, and so on.

Method 200 begins with step 201 where a hole 300 is dug at least partially beneath a structure 105 and its foundation 110. Proceeding to step 205, a first pile segment 10-1, substantially the same as pile segment 10 previously described, is positioned on the surface of the soil 70 at the bottom of hole 300. In particular, first pile segment 10-1 is vertically oriented with its trunk 28-1 contacting the surface of soil 70. First pile segment 10-1 is the first of a plurality of pile segments 10 that will be driven into the soil 70 to form pile 111 and underpinning (e.g., underpinning 100) such as those shown in FIG. 4.

With the first pile segment 10-1 properly positioned and oriented, a first reinforcing tubular segment 126-1 is inserted into bore 40-1 of first pile segment 10-1 and partially into the soil 70 according to step 210. It is to be understood that at this point, reinforcing tubular 125 comprises only first reinforcing tubular segment 126-1, and thus, the upper end of first reinforcing tubular segment 126-1 represents the first opening

125*a* of reinforcing tubular 125 while the lower end of first reinforcing tubular segment 126-1 represents second opening 125*b* of reinforcing tubular 125. Proceeding to step 215, a jetting tube 350 is inserted through first reinforcing tubular segment 126-1. Jetting tube 350 has an outlet end 350*a* and an inlet end 350*b* in fluid communication with outlet end 350*a*. Outlet end 350*a* of jetting tube 350 is preferably advanced through first reinforcing tubular segment 126-1 until outlet end 350*a* reaches, or extends slightly from, the lower end of first reinforcing tubular segment 126-1 (i.e., second opening 125*b*). Jetting tube 350 is preferably a flexible tube made of a polymer or rubber material.

Proceeding to step 220, inlet end 350*b* of jetting tube 350 is connected to a fluid jetting system (not shown). In some embodiments, prior to connecting inlet end 350*b* to the fluid jetting system, jetting tube 350 may be threaded through a plurality of unconnected reinforcing tubular segments (e.g., reinforcing tubular segment 126-4) and/or threaded through a plurality of individual pile segments (e.g., pile segment 10-4). In some cases, the reinforcing tubular segments and pile segments may be threaded in an alternating fashion.

Once outlet end 350*a* is sufficiently positioned and inlet end 350*b* is coupled to the fluid jetting system, a jetting fluid, such as water or the like, is pumped by the fluid jetting system through flexible tubular 350. Specifically, the jetting fluid flows into inlet end 350*b*, through jetting tube 350, and out of outlet end 350*a*. The jetting fluid moistens and loosens the soil 70 beneath first pile segment 10-1 and pile 111. Moistening and loosening the soil 70 in this manner offers the potential to soften and reduce the resistance of the soil 70 to driving of pile segments 10 and pile 111 into the soil 70. Consequently, the jetting process is intended to improve the ease and speed, as well as depth, that a jack or ram 325 can drive pile segments 10 and pile 111.

Proceeding now to step 225, a jack or ram 325 is positioned between foundation 110 and first pile segment 10-1. Jack 325 may comprise any suitable device capable of applying a vertical force 80 sufficient to drive first pile segment 10-1 and pile 111 into the soil 70 including, without limitation a mechanical jack, a hydraulic jack, or the like. Jack 325 is preferably positioned to engage substantially the center of upper surface 33 of head 30 of the uppermost pile segment 10 to enable controlled, uniform vertical displacement of pile segment 10 into the soil 70. In some embodiments, a spacer block 320 is positioned atop of the pile segment between the pile segment and jack 325. Spacer block 320 is intended to enhance uniform distribution of vertical forces 80 across upper surface 33. Such a spacer block 320 preferably includes a counterbore or recess 321 in its lower surface adapted to receive the upper end of uppermost reinforcing tubular segment 126-1. In this manner, axial forces may be applied uniformly to upper surface 33 without crushing or damaging the upper end of the uppermost reinforcing tubular segment 126-1. In addition, to enable continuous jetting while driving, spacer block 320 also preferably includes a radial through passage or groove in fluid communication with the counterbore 321. Jetting tube 350 is positioned through such a passage or groove, through the counterbore 321 and into reinforcing tubular segment 126-1. In this manner, jetting fluid may continue uninterrupted through spacer block 320 as pile segment 10-1 (as well as subsequent pile segments) is driven by jack 325. In general, spacer block 320 may comprise any suitable material or shape; but preferably comprises an aluminum rectangular block.

With jack 325 sufficiently positioned, jack 325 is extended to push upward in the direction of arrow 18 on foundation 110 and downward in the direction 16 on first pile segment 10-1. In other words, using slab 110 as leverage, jack 325 is actuated to drive first pile segment 10-1, and ally subsequent pile segments in pile 111, downward according to step 230. As previously described, moistening and loosening the soil 70 by the jetting process both prior to and during the driving of first pile segment 10-1 and pile 111 into the soil 70 offers the potential to soften the soil 70 and improve the ease and speed, as well as depth, that jack 325 can drive first pile segment 10-1 and pile 111. In addition, moistening of the soil 70 with the jetting fluid tends to create lubricating effect, thereby reducing frictional forces between first pile segments 10 and the surrounding soil 70.

Proceeding to step 235, if first pile segment 10-1 and pile 111 have reached a sufficient depth to support, stabilize, and/or level structure 105 and foundation 110, then fluid jetting may be terminated according to step 240. In such a case, pile construction process 200 is complete and the remainder of the underpinning (e.g., underpinning 100) may be finished according to the underpinning completion process described in more detail below. However, if first pile segment 10-1 and pile 111 have not reached a sufficient depth, then a subsequent pile segment 10 and tubular segment 126-2, such as a second pile segment 10-2 and a second tubular segment 126-2, must be added to pile 111 and reinforcing tubular 125. Specifically, jack 325 and spacer block 320 are removed from on top of the pile 111 according to step 245. Then proceeding to step 255, second tubular segment 126-2 is slid downward into position and coupled to the first tubular segment 126-1 already in place, and second pile segment 10-2 is placed atop, and vertically aligned with, first pile segment 10-1 according.

It should be appreciated that by pre-threading tubular segments and pile segments along jetting tube 350 as described above, the fluid jetting process need not be repeatedly interrupted to when additional tubular segments and/or pile segments need to be installed. In other words, with a sufficient number of tubular segments and pile segments threaded on jetting tube 350, the jetting process need not be stopped and inlet end 350*b* disconnected from the jetting system in order to install additional tubular segments 126 and/or pile segments 10. Alternatively, in embodiments where inlet end 350*b* of jetting tube 350 is connected to the fluid jetting system without first inserting it through additional rod segments and pile segments, fluid jetting may need to be interrupted to disconnect inlet end 350*b* from the fluid jetting system and to install additional rod segment(s) and/or pile segment(s). After adding the next rod segment and pile segment to the pile, inlet end 350*b* may be reconnected to the fluid jetting system and the jetting process continued.

Proceeding again to step 225, jack 325, and optionally spacer block 320, are repositioned and utilized to drive second pile segment 10-2 and pile 111 (now comprising first pile segment 10-1 and second pile segment 10-2) into the soil 70 as previously described with respect to step 225. Fluid jetting is preferably continued as second pile segment 10-2 and pile 111 is driven into the ground by jack 325. This process of removing jack 325 and spacer block 320, adding another pile segment to pile 111, adding another reinforcing tubular segment to reinforcing tubular 125, repositioning jack 325 and spacer block 320 between foundation 110 and pile 111, and driving pile 111 into the soil 70 is repeated until pile 111 achieves a sufficient depth. Once pile 111 has reached a sufficient depth and fluid jetting has been terminated according to step 240, jack 325 and spacer block 320 may be removed from pile 111, the remainder of the underpinning (e.g., the underpinning base, cap, spacers, etc.) is completed according to the underpinning completion process 400 illustrated in FIG. 7.

Figure 7:
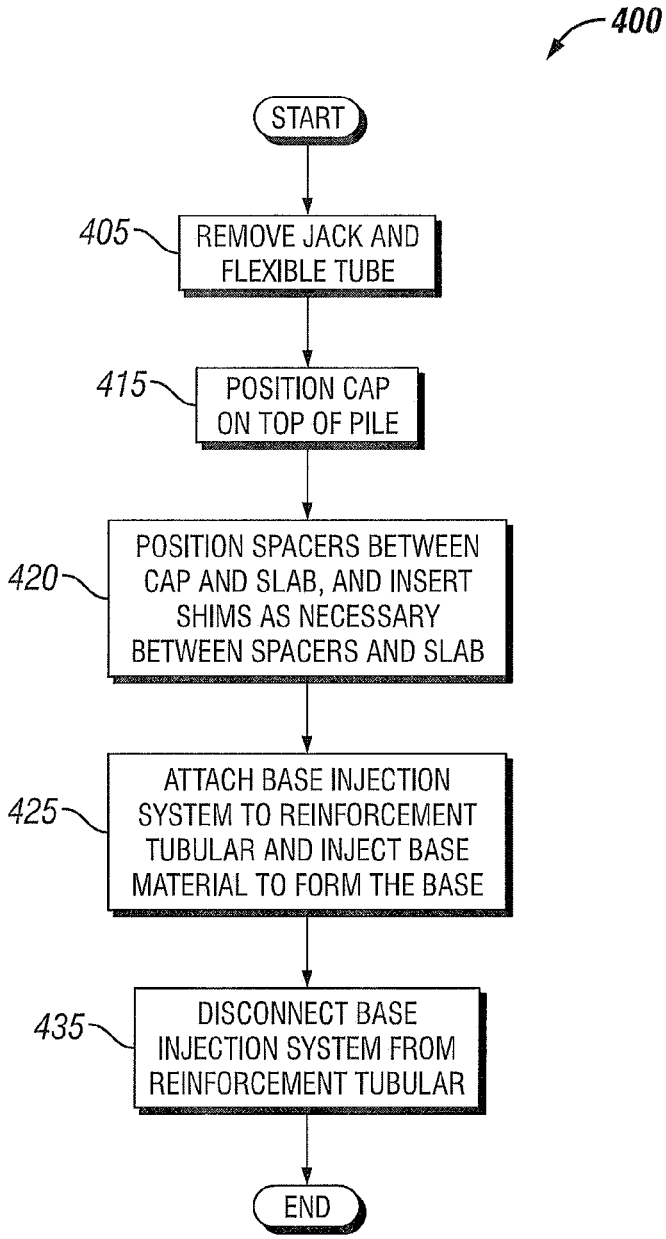
FIG. 7 is a logic flow diagram of a representative method to form a support base beneath the pile constructed according to FIG. 5.

Referring now to FIGS. 4, 6, and 7, once pile 111 is driven to a sufficient depth, the remainder of underpinning 100 (e.g., support base 135, cap 112, spacers 115, etc.) (FIG. 4) may be constructed according to an underpinning completion process 400 (FIG. 7). Starting with step 405, jack 325 is removed from between the top of pile 111 and slab 110, and further, jetting tube 350 is removed from reinforcing tubular 125. Next, cap 112 is positioned on top of pile 111 according to step 415. As best seen in FIG. 4, cap 112 is preferably positioned such that bore 113 of cap 112 is aligned with passage 130 of pile 111. In such an orientation, first end 125*a* of reinforcing tubular 125 is permitted to slid into bore 113 without damaging or bending first end 125*a*. Reinforcing tubular 125 is preferably long enough to extend completely throughbore 113 such that first end 125*a* extends beyond cap 113. In the case reinforcing tubular does not extend completely throughbore 113, one or more additional reinforcing tubular segments 126 may be coupled to reinforcing tubular 125, thereby increasing its length.

Referring specifically to FIGS. 4 and 7, proceeding to step 420, spacers 115 are then positioned between cap 112 and slab 110. If necessary, one or more shims 155 may be inserted between spacers 115 and stab 110 to ensure a tight fit between spacers 115 and slab 110 such that pile 111 will be restricted from substantial lateral movement.

Proceeding to step 425, a base material injection system (not shown) is connected to first end 125*a* of reinforcing tubular 125. The material forming support base 135 is then injected in a flowable state (e.g., liquid, wet slurry, etc.) into first end 125*a*, through reinforcing tubular 125, and out of second end 125*b*. The flowable base material is intended to fill any spaces and voids in the soil proximal the bottom of pile 111. The base material preferably hardens over time into a solid mass, thereby forming support base 135. For instance, the base material may comprise a concrete slurry, grout, or polyurethane is flowed under pressure through reinforcing rod 125 and deposited under pile 111. As stated previously, support base 135 supports pile 111 and restricts vertical pile 11 from further settling into the soil.

Reinforcing tubular 125 may also be filled with the base material. Without being limited by this or any particular theory, as the base material solidifies within reinforcing tubular 125, it increases the rigidity and strength of reinforcing tubular 125, thereby enhancing the ability of reinforcing tubular 125 to resist lateral misalignment of pile segments 10 in pile 111 that may otherwise occur from the shifting, swelling, and/or shrinking of the surrounding soil 70.

Proceeding now to step 435, after the support base 135 is formed and reinforcing rod 125 is filled with the base material, the base injection system is disconnected from first end 125*a* of reinforcing tubular 125. At this point, foundation underpinning 100 is substantially complete and hole 300 may be refilled.

While various embodiments of a foundation underpinning and its methods of installation have been shown and described herein, modifications may be made by one skilled in the art without departing from the spirit and the teachings herein. The embodiments described are representative only, and are not intended to be limiting. Many variations, combinations, and modifications of the applications disclosed herein are possible and are within the scope of the invention. Accordingly, the scope of protection is not limited by the description set out above, but is defined by the claims which follow, that scope including all equivalents of the subject matter of the claims.

What is claimed is:

1. A foundation underpinning to support a foundation comprising:

a pile including a plurality of pile segments, aligned end to end, the pile having an uppermost pile segment and a lowermost pile segment with the remaining pile segments positioned therebetween, wherein each of the one or more pile segments comprises:

a head;

a trunk extending from the head; and a throughbore passing axially through the head and the trunk, the throughbore having a longitudinal centerline;

wherein the area of a cross-section through the head and normal to the centerline is greater than the area of a cross-section through the trunk and normal to the centerline, and the head includes a lower annular surface normal to the centerline; and wherein the throughbores of the one or more pile segments are vertically aligned forming a passage through the pile; and an elongate reinforcing tubular disposed within the passage and extending from within the uppermost pile segment into the lowermost pile segment, the reinforcing tubular formed of a plurality of tubular segments coupled end-to-end, wherein at least one end of each tubular segment in connected to an end of an adjacent tubular segment and forming a passage through the pile.

2. The foundation underpinning of claim 1, further comprising a support base positioned beneath and at least partially engages the pile.

3. The foundation underpinning of claim 2, wherein the support base comprises a base material selected from the group consisting of concrete, grout, and polyurethane.

4. The foundation underpinning of claim 3, wherein the reinforcing tubular is filled with the base material.

5. The foundation underpinning of claim 1, wherein the elongate reinforcing tubular comprises a plurality of elongate reinforcing tubular segments coupled end-to-end.

6. The foundation underpinning of claim 5, wherein the elongate reinforcing tubular segments comprise galvanized pipe.

7. The foundation underpinning of claim 5, wherein the elongate reinforcing tubular segments are coupled end-to-end with mating threads.

8. The pile segment of claim 1, wherein the head and the trunk are cylindrical, and wherein the head has a head diameter and the trunk has a trunk diameter, the trunk diameter being less than the head diameter.

9. The foundation underpinning of claim 1, further comprising a cap and one or more spacers positioned between the pile and the foundation.

10. A method of installing a foundation underpinning comprising:

driving a first pile segment downward into the soil, the first pile segment comprising:

a head;

a trunk extending from the head; and a throughbore passing axially through the head and the trunk, the throughbore having a longitudinal centerline;

wherein the area of a cross-section through the head and normal to the centerline is greater than the area of a cross-section though the trunk and normal to the centerline, such that the head has lower annular surface normal to the longitudinal centerline;

inserting a first elongate tubular segment at least partially into the throughbore of the first pile segment;

coupling a second elongate tubular segment to the first elongate tubular segment, wherein at end of the second elongate tubular segments is connected to an end of the first elongate tubular segment;

positioning a second pile segment on top of the first pile segment, the second pile segment substantially identical to the first pile segment, wherein the throughbore of the second pile segment is vertically aligned with the throughbore of the first pile segment; and wherein the second elongate tubular segment extends at least partially into the throughbore of the second pile segment and forms a passage through the second pile segment and the first pile segment for a flowable substance.

11. The method of claim 10, further comprising:

digging a hole at least partially beneath the foundation; and positioning the first pile segment at the bottom of the hole.

12. The method of claim 10, further comprising driving the first pile segment and the second pile segment downward into the ground.

13. The method of claim 12, wherein driving the first pile segment and the second pile segment comprises:

positioning a jack between the foundation and the second pile segment;

actuating the jack to force the second pile segment and the first pile segment downward; and using the foundation as leverage for the jack.

14. The method of claim 10, further comprising forming a support base below the first pile segment.

15. The method of claim 14, wherein forming the support base comprises:

injecting a base material through the throughbore of the first pile segment and into the ground below the first pile segment.

16. The method of claim 15, wherein the base material comprises a flowable substance that solidifies at ambient temperature.

17. The method of claim 16, wherein the base material comprises a substance selected from the ground consisting of concrete, grout, and polyurethane.

* * * * *